US008590975B2

(12) United States Patent
Cox

(10) Patent No.: US 8,590,975 B2
(45) Date of Patent: Nov. 26, 2013

(54) FURNITURE CONSTRUCTION

(76) Inventor: Emily Cox, Cary, IL (US)

( * ) Notice: Subject to any disclaimer, the term of this patent is extended or adjusted under 35 U.S.C. 154(b) by 27 days.

(21) Appl. No.: 13/330,694

(22) Filed: Dec. 20, 2011

(65) Prior Publication Data

US 2012/0228916 A1 Sep. 13, 2012

Related U.S. Application Data

(63) Continuation-in-part of application No. 29/387,094, filed on Mar. 9, 2011, now Pat. No. Des. 651,427.

(51) Int. Cl.
*A47C 7/16* (2006.01)

(52) U.S. Cl.
USPC ..... 297/440.1; 297/440.15

(58) Field of Classification Search
USPC ..... 297/440.1, 440.12, 440.13, 440.14, 297/440.15
See application file for complete search history.

(56) References Cited

U.S. PATENT DOCUMENTS

| | | | | |
|---|---|---|---|---|
| 4,067,615 | A | 1/1978 | Gehry | |
| 4,235,473 | A | 11/1980 | Aginar | |
| 4,322,109 | A | 3/1982 | Thebaud | |
| 6,824,221 | B1 | 11/2004 | Tiffany, III et al. | |
| 6,997,514 | B2 * | 2/2006 | Tarantino et al. | 297/440.14 X |
| 7,044,557 | B2 * | 5/2006 | Wieland | 297/440.1 X |

* cited by examiner

*Primary Examiner* — Anthony D Barfield
(74) *Attorney, Agent, or Firm* — Invention Protection Associates, LLC

(57) ABSTRACT

Furniture is constructed from a plurality of vertically oriented slats whose upper edges form at least one functional surface and that have tabs formed along their side edges and accommodating notches formed within their bottom edges. Tabs fit within notches allowing slats to connect perpendicularly and hold each other upright in spaced relation without a superstructure or any continuously extending support components.

8 Claims, 5 Drawing Sheets

FURNITURE CONSTRUCTION

This application is a continuation-in-part application that claims the benefit of application no. 29/387,094 filed Mar. 9, 2011.

BACKGROUND

The present invention generally relates to furniture construction, and it is specifically directed to a structural design for load-bearing, slatted furniture which renders furniture articles having unique and pure aesthetic appearance and superior structural stability, and which lends itself to remarkably highly efficient raw material utilization in the furniture fabrication process.

The prior art is replete with designs for furniture. More pertinently, the prior art even includes multiple references that teach structural designs in which a multitude of planar pieces of material (hereinafter, to be generally referred to as "slats") are arranged in spaced, vertical planes and parallel relation to each other to form an aesthetic, yet functional (i.e., load-bearing), furniture item. Invariably, these designs for slatted furniture incorporate either a contiguous support frame to which the load-contacting slats are attached, or they include at least one elongate connector element (e.g., rod, dowel, ribs, etc.) which traverses all of the slats and holds them together in a support posture.

One example of the latter design is found in U.S. Pat. No. 4,067,615 to Gehry. Gehry discloses a furniture article formed of a plurality of slats specifically made of corrugated cardboard. The slats are disposed in parallel, vertical planes and can be either glued together at their faces or held in spaced relation by way of inserting glue-coated stringers transversely through corresponding slots formed within the slats. Of course, it should be anticipated that, in order to support the considerable weight of a human being of average or greater size, cardboard slats would necessarily have to be stacked directly together or at least have extremely narrow interstitial spaces.

in another example, U.S. Pat. No. 4,235,473 to Aginar discloses a slatted furniture construction in which the upper edges of a plurality of uniformly thick slats are shaped to compositely form a functional surface. The slats are joined together by "interconnecting means" which pass through axially aligned holes in the slats, as well as a plurality of spacing means that combine to hold the slats in spaced, face-to-face relation. It is suggested that the interconnecting means could be a dowel that is fixedly locked against the slats by way of friction, adhesive or conventional fasteners (e.g., nails, screws, etc.), and it is described that at least one, and preferably more than one, of the spacer means should be situated between every two adjacent slats.

In yet another example, U.S. Pat. No. 4,322,109 to Thebaud discloses a foldable chair formed by two separate groups of elongate slats that, it is suggested, are to be made of rigid material such as hardwood, plywood, plastic or metal. A rod which passes through axially aligned holes residing in both group's slats acts as a folding hinge and allows the chair to form an X shape, as seen from a side view, when in unfolded condition. Tension rods with axes parallel to the slat planes' are employed to hold that "X" in place, and Thebaud explicitly suggests that these rods be made of steel or like material because of the great tensile forces that act upon them when a person is sitting on the chair. The two upper extensions of the "X" provide cantilevered seat and backrest support and, therefore, must be designed to withstand considerable shearing and other forces that they will be subjected to. The slats within each grouping are further held in spaced, parallel relation by both at least one transverse rod passing through holes near the end(s) of each slat and spacers disposed between each adjacent slat.

There are some typical characteristics of these and other slatted furniture constructions of the prior art. As was previously mentioned and is true of all the above described examples, incorporated into the design is at least one transverse connector element that continuously extends through the entire lateral span of longitudinally-oriented, parallel-planed slat pieces whose edges define functional surfaces that directly contact a supported load (e.g., a person) and the floor. In virtually every case that the present inventor is aware of, a transverse connector element(s) is required in order to maintain the upright attitude of vertical slats. Furthermore, in some cases like Aginar and Thebaud, continuous transverse connector elements are also essential aspects of the furniture item's load support capability. Consequently, and because artistic considerations are often considered paramount in slatted furniture constructions, in the art of slatted furniture design, there exists a design tension between achieving an acceptable balance of load support capacity and lightness, on one hand, and satisfying more aesthetic concerns such as preserving constituent material homogeneity or having slat orientation diversity on the other hand.

For instance, strength requirements for transverse connector elements essential to the load support structure may necessitate that those elements be fabricated of material different from that which is preferred for the slats (examples: steel transverse rods combined with plywood slats; visible metal fasteners used to secure non-metal transverse elements to like material slats). Furthermore, the mere visible presence of elongate connector elements render unsightly, if not impractical, furniture designs featuring slats arranged non-parallel to each other. That is because non-parallel slats may not be traversed by and connected to the transverse connector (s), but rather, would be oriented in planes parallel thereto and, therefore, might necessitate the inclusion of additional connector elements which extend through the non-parallel slats in order to give them stability.

Consequently, the present inventor appreciates a need for anew construction for slatted furniture that, among a plethora of other benefits, both lends itself to creating functional furniture items that do not require elongate, structurally supportive connector elements which extend continuously through all of the very slats compositely defining their functional surfaces and that forms a unique design which is apparent from a plan or perspective viewing. The present invention substantially fulfills this need.

SUMMARY

Slatted furniture generally is popular for a variety of reasons, one being simplicity of manufacture. For example, often, when a slatted furniture construction comprises slats that are planar pieces of material, multiple units of the construction can be mass produced by cutting stacked material sheets to simultaneously create corresponding slats for each unit. And even if the sheets are too thick and rigid to be stack-cut, the planar geometry of furniture slats may necessitate use of a single type of cutting device as the only machine tool needed to create the slats, possibly simplifying the slat production task. However, other furniture components (e.g., connectors and spacers) may require altogether different raw materials and machining processes.

It is an object of the present invention to amplify the aforementioned benefits generally associated with manufacturing slatted furniture. For example, in one aspect of the present invention, the slatted construction is made up of only slat components and spacer components that all have the same planar cross-sectional profile and that can be made from the same material. Consequently, not only can a single type of cutting machine be used to mass produce every component of the present construction, but all of those slats and spacers can be cut-formed from the same sheet material. Then, in another aspect of the invention, raw material consumption is minimized due to the fact that the slats and spacers are produced from nested cutting patterns to be cut from sheet material. In the nested patterns, cut lines for distinct furniture pieces (i.e., slats and spacers) are in a jigsaw arrangement and, in some cases, are enveloped within the cut lines for other pieces. Not only do these nesting arrangements create material efficiency, they also produce slat and non-continuous spacer components having edge geometries that enable them to precisely interfit with each other and render unnecessary separate, continuous connector components. Also, as is the case with some other slat constructions, the slat and spacer parts of the present construction can be tidily packed into container space of not much greater volume than that of the parts themselves, thereby increasing the number of ready-to-sell, unassembled furniture units that can be placed within a given-sized retail or warehousing space.

In addition to efficiency considerations, and as with furniture designs of any type, pure aesthetics are also important aspect of slatted furniture designs. Typically, there are four factors—the outer profile of the composite slat construction, the shape profiles of individual slats within the construction, the presence of interstitial voids between adjacent slats, and the relative orientation of slats and other constituent parts—that define the appearance of a slatted furniture item. The present invention, however, is for a slatted furniture construction that embodies additional design characteristics which have both aesthetic appeal and utilitarian value.

In fact, it is an object of the present invention to provide a slatted construction whose artistic design not only does not compromise the usefulness or structural integrity of the furniture item, but that actually enhances those aspects of it. For example, in one design aspect of a sitting chair manifestation of the present invention, most slats in the construction have generally polygonal shapes, and no two slats are completely identical. Each slat at least marginally differs from all others with respect to shape and/or scale. For instance, gradual changes in the respective height profiles of parallely adjacent and otherwise similarly shaped slats provide aesthetically appealing arcuateness to portions of the chair's outer profile. That design aspect also makes for ergonomic seat and backrest surface contours.

In another design aspect of the invention, the present slatted furniture construction lacks any superstructure and is further devoid of any structural support or connector components that are continuously elongate in a direction transverse to its parallel slats. In this context, "continuously elongate" refers to the characteristic of being dimensioned to extend through multiple spaced, parallel slats. Instead, the construction is defined by three distinct sets of multiple slats: two sets in which slats are arranged in parallel relation to each other and have gradually increasing lateral dimensions and a third set in which the slats are oriented perpendicular to the other two sets' slats and are situated between them. As will be explained in more detail later, the perpendicular slats are interfittingly joined to parallel slats at conforming "tabs" and "notches" disposed along their respective edges. From a plan view, this slat arrangement appears to form a Z-like pattern which the present inventor has observed to be a rare, if not singularly unique, aspect of slatted furniture as not only an aesthetic matter, but as a structural design matter as well.

Flush abutment of corresponding lateral edges of the slats within each parallel set with both side surfaces of the slats within the interposed perpendicular set causes the slats to reciprocally laterally stabilize each other without the aid of any separate, continuously elongate connector elements as, in fact, the perpendicular slats which form part of a functional surface(s) themselves effectively act as connector elements joining the parallel slats of each two sets. Moreover, this Z-like slat layout renders an interiorly disposed frame or any continuously elongate support or connector elements virtually geometrically incompatible, anyway.

Finally, it is an object of the invention to exhibit exceptional load capacity and structural stability in light of the material used. In this regard, the absence of support elements separate from the slats and spacers employed can be consequentially beneficial—to an extent which greatly depends on the particular slat material used—in that heavier than anticipated load being placed upon the functional surface does not result in potentially destructive magnitude shearing forces being translated to any such support elements. In fact, as a general matter, any vertical load component experienced by the present construction has a more withstandable compressing force effect on the vertically disposed slats (and none on the spacers) than it has less tolerable shearing or bending force effects on anything. This enables thinner, lighter material slats with less bend strength to be used than would otherwise be the case.

DESCRIPTION OF A PREFERRED EMBODIMENT

Figure 5:
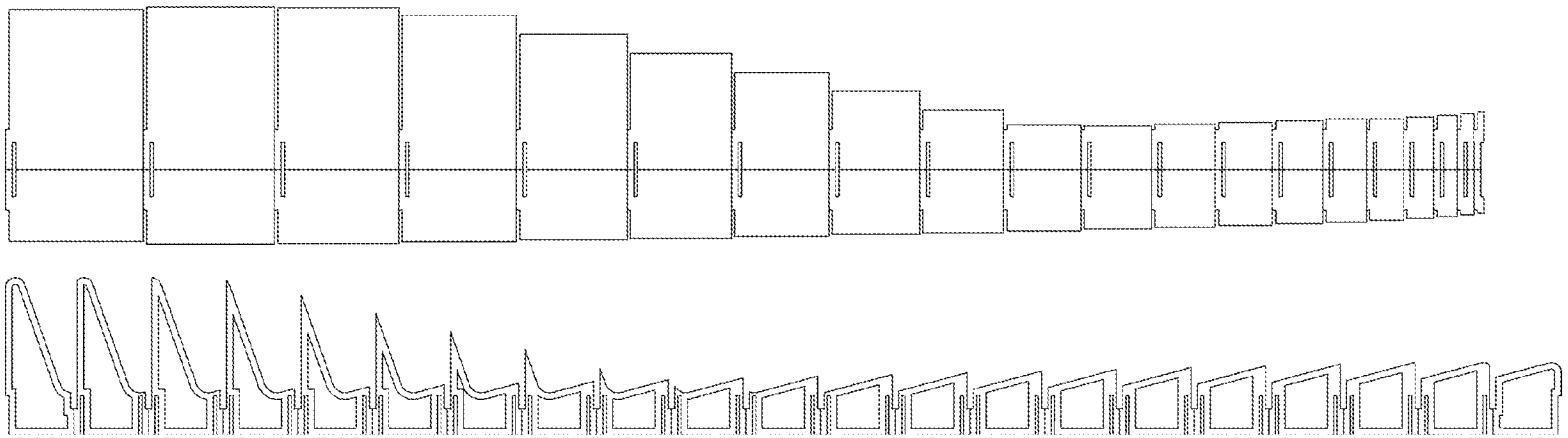
FIG. 5 shows the unassembled slat pieces of the chair.
Figure 6:
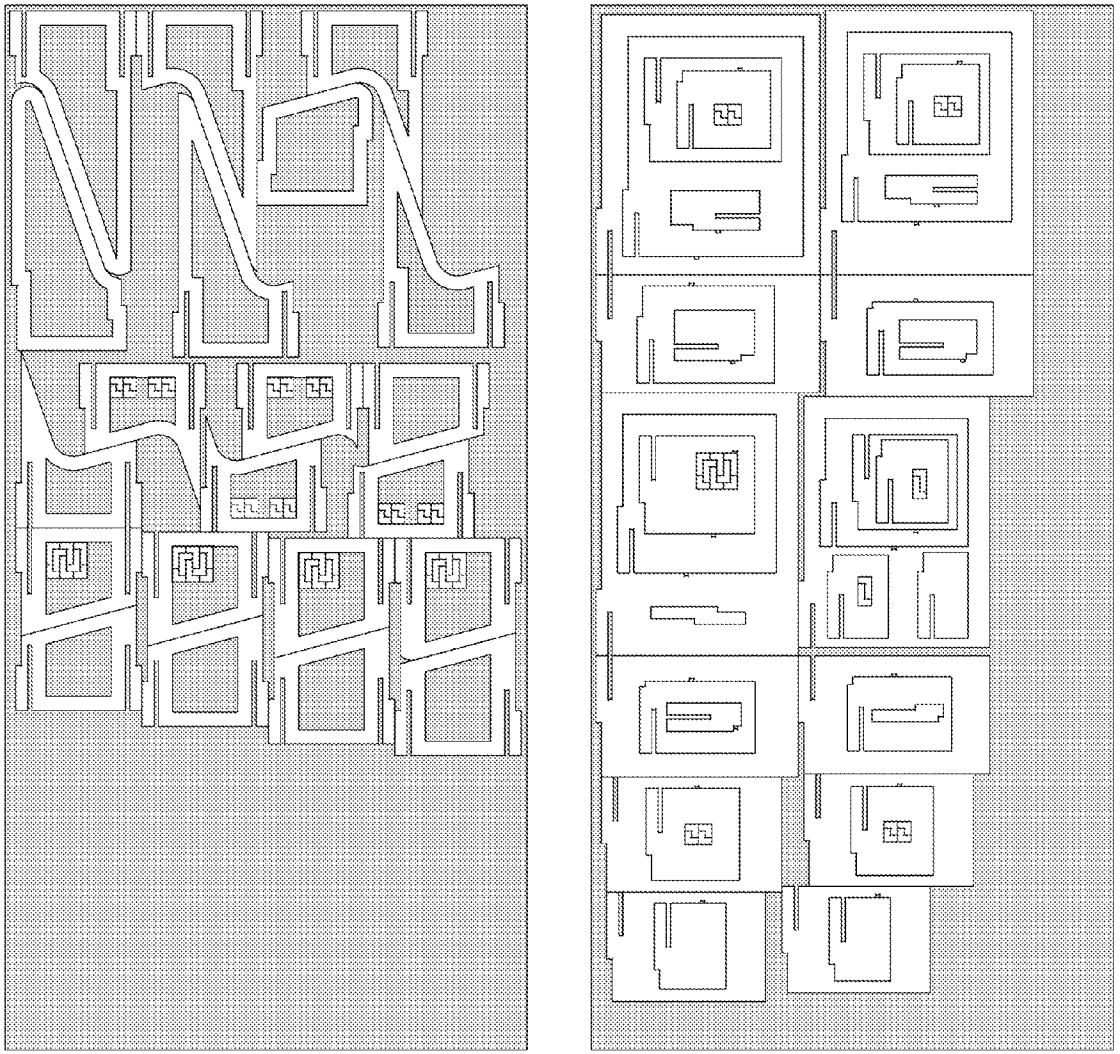
FIG. 6 shows two sheets of material with nested cutting lines for producing said slat pieces drawn thereon.

Although the exact appearance of the present invention can vary, its preferred embodiment is in the form of an ergonomic chair formed by an interjoined multitude of slat pieces and L-shaped spacer pieces. In fact, an unassembled collection of sixty-one such pieces are shown in FIGS. 5 & 6, while differing views of the preferred construction of them are depicted in FIGS. 1-4. Preferably, all of the pieces are formed from a single wood material, such as birch plywood, but they can be virtually any material(s) possessing strength properties to safely support the weight of a human being seated upon the assembled construction.

As is noticeable in FIG. 6 especially, each slat is uniquely shaped, and most have an interior void area which both helps to form the appearance of the chair construction and significantly reduces its weight. Furthermore, most of the slats also have at least one elongate vertical notch formed along their bottom edges, as well as an outwardly jutting segment, or tab, formed along at least one of their side edges. These cooperating tabs and notches allow slats to be perpendicularly joined without any extraneous fastening devices, as a tab along a particular slat is sized to snugly occupy an entire notch along another particular slat. The precisely dimensioned slat and spacer pieces may be efficiently created using a CNC router to out sheet material along intricate, nested cutting patterns displayed in FIG. 6.

Figure 1:
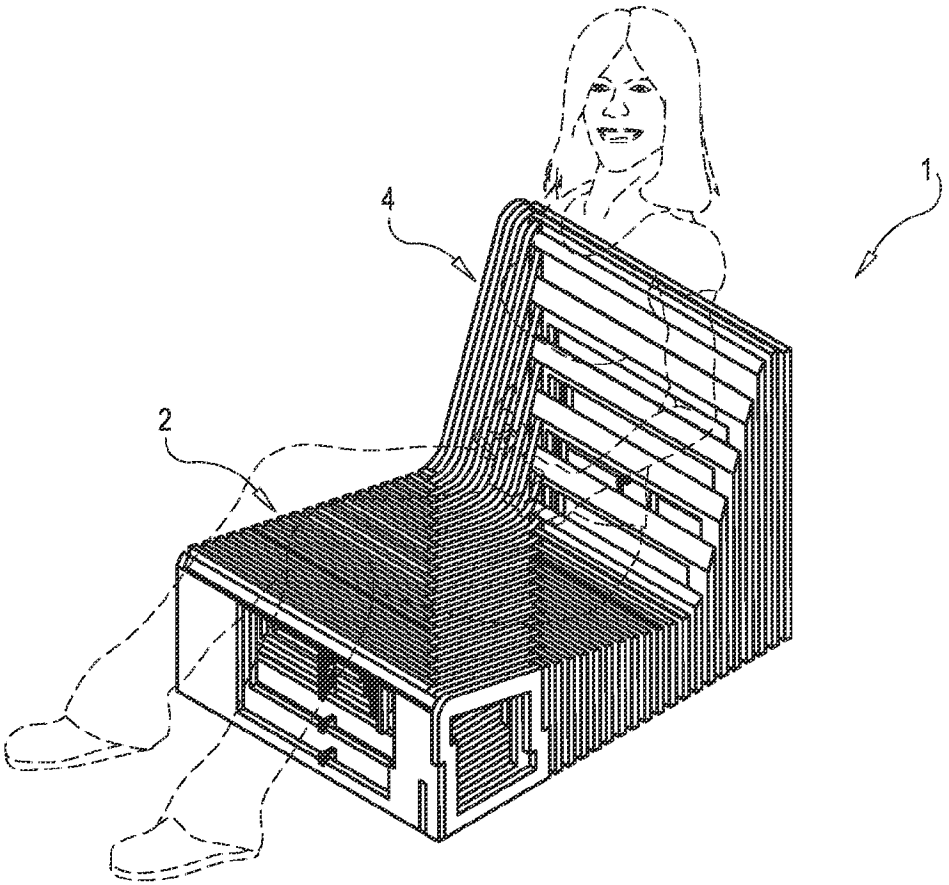
FIG. 1 is a top, front, left side perspective view of a chair that is a preferred embodiment the furniture construction of the present invention, the chair being shown with a person seated thereupon.
Figures 2, 3:
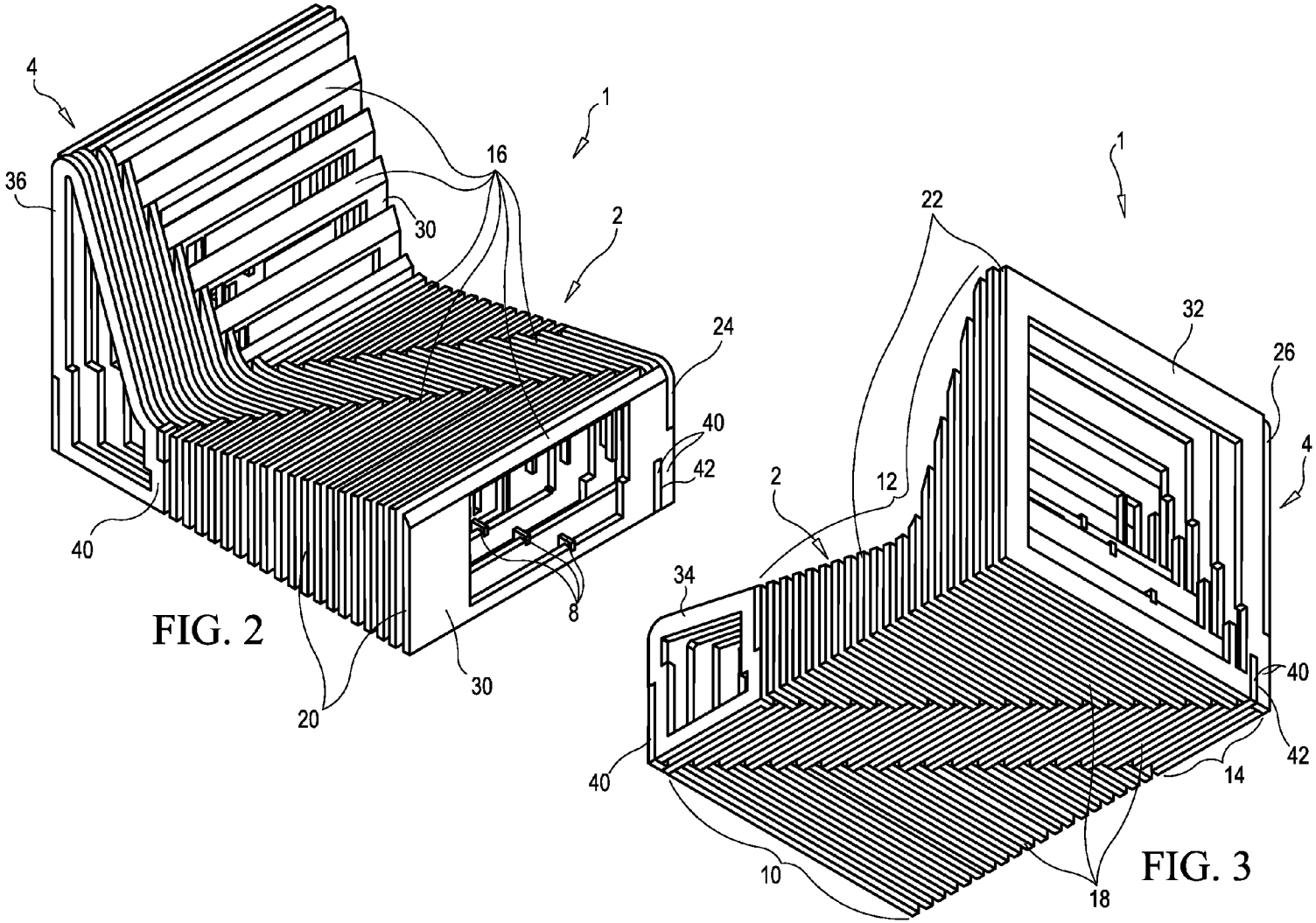
FIG. 2 is a top, front, right side perspective view of the chair.
FIG. 3 is a bottom, rear, left side perspective view of the chair.

Referring now to FIGS. 2 & 3, illustrated is the aforementioned chair 1 which has contiguous seat and backrest portions 2, 4. In fact, the seat portion 2 is formed by three distinguishable sets of slats 10, 12, 14 which are all oriented in vertical planes, and the backrest portion 4 is formed by two of those slat sets 12 & 14. The entire bottom edges 18 of all slats 10, 12, 14 contact the floor so that the compressive force of a human body resting upon the chair is distributed among most, if not all, of the slats 10, 12, 14. Furthermore, as can be best seen in FIG. 2, the top edges 18 of slats are beveled to form a comfortable sitting surface. This is particularly true of the frontmost slat of the first set 10 and multiple second set slats 12 that form part of the backrest 4.

Slats within the first set 10 are parallel to each other and are equally spaced longitudinally—preferably, a distance equal to the common cross-sectional thickness of the slats 10. However, their lateral (i.e., left-to-right) lengths are progressively shorter with each rearwardly succeeding slat 10. As can be gleaned from comparing 2 & 4, the right edges 20 of these first set slats 10, together with the right face 36 of the rightmost slat of the third set 14, are along an invisible vertical plane, while their respective left edges are along a zigzagging diagonal line. Also, as is reflected in FIGS. 2 & 3, the respective height dimensions of first set slats 10 are (progressively varied and their top edges 16 are complimentarily beveled so as to create an ergonomically contoured surface along the right-front portion of the seat 2 that they form. More specifically, within this first set of slats 10, the frontmost slat is the tallest and the rearmost slat is the vertically shortest. In addition, each of these slats 10 features a leftward extending tab 40 along a bottom portion of its left edge, as well as a vertically extending notch 42 formed within its bottom edge 18 adjacent that tab 40.

The longitudinally spaced slats of the second set 12 are parallel to those of the first set 10 and are similarly spaced longitudinally, but form a left-rear portion of the chair seat 2 and a considerable portion of the backrest 4. A front group of second set slats 12, whose upper edges 16 constitute part of the seat 2, are height dimensioned and beveled to match laterally separated, but coplanar first set slats 10. However, within a rear group of second set slats 12—those slats 12 which form most of the backrest 4—the beveling is even more pronounced and slat heights become progressively taller going rearward. Also, in contrast with the first set 10, lateral lengths of the second set slats 12 become greater with each rearwardly succeeding one. Consequently, similar to the first set slats 10, the left edges 22 of the second set slats 12, as well as the left side 34 of the leftmost slat of the third set 14, are along an invisible vertical plane, while their right edges form another zigzagging diagonal line. In addition, each second set slat 12 features a rightward extending tab 40 extending along a bottom portion of its right edge, as well as a vertically extending notch 42 formed within its bottom edge 18 adjacent that tab 40.

The third set slats 14 are parallel to each, but are laterally spaced a distance equal to slat thickness and run perpendicular to the first and second set slats 10, 12. The top edges 16 of these third set slats 14 seamlessly fit within the contours of either the chair seat 2 or backrest 4 which are partially formed by first set and some second set slats 10, 12 and by other second set slats 12, respectively. Furthermore, other than the frontmost and rearmost two slats of the third set 14, each third set slat 14 has an opposing pair of bottom notches 42—one near the meeting of its bottom and front edges 18, 24 and another near the meeting of its bottom and rear edges 18, 26. Each of these dual-notch slats 14 also features a pair of opposing tabs 40 extending along bottom portions of its front and rear edges 18, 26. In fact, the notches 42 and tabs 40 formed along most of the third set slats 14 allow each of those slats 14 to link a first set slat 10 and a second set slat 12.

More specifically, the front tab 40 of a third set slat 14 forms a perfect fit within the notch 4 a first set slat 10, and its rear tab 40 fits within the notch 42 of a second set slat 12, so that the three slats 10, 12, 14 hold each other upright in a laterally stable, Z-like formation without any additional support. The non-tab portions of the left edges of first set slats 10 abut the right faces 36 of third set slats 14, and the non-tab portions of the right edges of second set slats 12 abut their left faces 34. Similarly, the non-tab portions of the front edges 24 of third set slats 14 abut the rear faces of first set slats 10, and the non-tab portions of their rear edges 26 abut the front faces 30 of second set slats 12. Preferably, the linkage is further secured by applying adhesive material (not shown) to the interior surfaces of the notches and to portions of slat edges that are to perpendicularly abut faces of other slats prior to assembling the chair 1.

Figure 4:
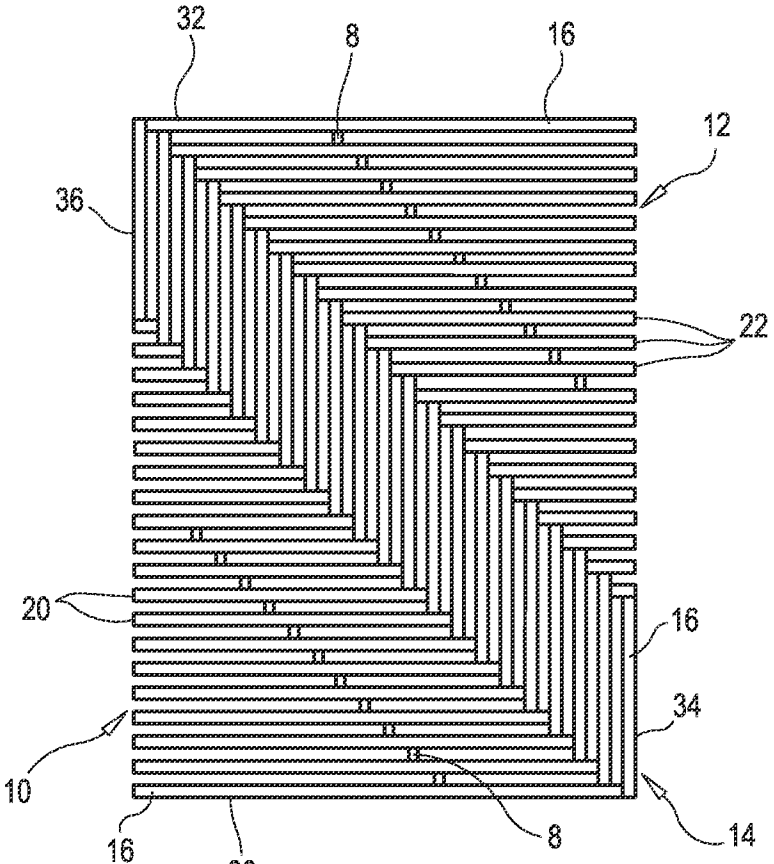
FIG. 4 is a top plan view of the chair.

Finally, as can be understood by comparing FIGS. 2 & 4, one leg of an L-shaped spacer 8 should be fitted into a small groove (not shown) formed along the interior lower edge of several first and second set slats so that the spacer's other leg wedges between adjacent parallel slats within the first and second sets 10, 12. These spacers 8 improve the structural stability of the chair 1 by inhibiting slats that they are positioned between from toppling forward or backward. The spacers 8 should be adhesively bonded into place as well.

Aspects of various embodiments of the present invention that are not recited above or claimed below may be noted from observing the illustrations included herein.

What is claimed is:

1. A chair having a seat and a backrest, the chair comprising:

a first plurality of slat-like members disposed in spaced vertical planes and having top, bottom, right and left edges and front and rear faces, wherein these slat-like members are generally parallel to each other, and wherein all first pluralty left edges are defined as surfaces perpendicular to the planes of all first plurality slat-like members and all first plurality rear faces are defined as surfaces parallel to the planes of all first plurality slat-like members;

a second plurality of slat-like members disposed in spaced vertical planes and having top, bottom, right and left edges and front and rear faces, wherein these slat-like members are generally parallel to each other and to the first plurality, and wherein all second plurality right edges are defined as surfaces perpendicular to the planes of all second plurality slat-like members and all second plurality front faces are defined as surfaces parallel to the planes of all second plurality slat-like members;

a third plurality of slat-like members dispose in spaced vertical planes and having top, bottom, front and rear edges and right and left faces, wherein these slat-like members are generally parallel to each other, but are generally perpendicular to the first and second pluralities, and wherein all third plurality front and rear edges are defined as surfaces perpendicular to the planes of all third plurality slat-like members and all third plurality right and left faces are defined as surfaces parallel to the planes of all third plurality slat-like members;

wherein the third plurality of slat-like members are situated between the first and second pluralities of slat-like members such that left edges of first plurality slat-like members flushly abut right faces of third plurality slat-like members, and right edges of second plurality slat-like members flushly abut left faces of third plurality slat-like members; and wherein the composite of top edges of all first plurality slat-like members define a portion of the seat surface, the composite of top edges of all second plurality slat-like members define portions of the seat and backrest surfaces, and the composite of top edges of all third plurality slat-like members define portions of the seat and backrest surfaces.

2. The article of furniture of claim 1, wherein spacing members are disposed between at least some adjacent, parallel slat-like members.

3. The article of furniture of claim 2, wherein said spacing members are adhesively bonded to the slat-like members that they are disposed between.

4. The article of furniture of claim 1, wherein most of said first, second and third plurality slat-like members have an interior void.

5. A chair having a seat and a backrest, the chair comprising:

a first plurality of slat-like members disposed in spaced vertical planes and having top, bottom, right and left edges and front and rear faces, wherein their right edges have tab portions and vertically extending notches are formed within their bottom edges near their right tab portions, wherein these slat-like members are generally parallel to each other, and wherein all first plurality left edges are defined as surfaces perpendicular to the planes of all first plurality slat-like members and all first plurality rear faces are defined as surfaces parallel to the planes of all first plurality slat-like members;

a second plurality of slat-like members disposed in spaced vertical planes and having top, bottom, right and left edges and front and rear faces, wherein their left edges have tab portions and vertically extending notches are formed within their bottom edges near their left tab portions, wherein these slat-like members are generally parallel to each other and to the first plurality, and wherein all second plurality right edges are defined as surfaces perpendicular to the planes of all second plurality slat-like members and all second plurality front faces are defined as surfaces parallel to the planes of all second plurality slat-like members;

a third plurality of slat-like members disposed in spaced vertical planes and having top, bottom, front and rear edges and right and left faces, wherein their front and rear edges have tab portions and pairs of vertically extending notches are formed within their bottom edges near their front and rear tab portions, wherein these slat-like members are generally parallel to each other, but are generally perpendicular the first and second pluralities, and wherein all third plurality front and rear edges are defined as surfaces perpendicular to the planes of all third plurality slat-like members and all third plurality right and left faces are defined as surfaces parallel to the planes of all third plurality slat-like members;

wherein third plurality slat-like members link first and second plurality slat-like members by virtue of first plurality tab portions being disposed within third plurality front notches, second plurality tab portions being disposed within third plurality rear notches, third plurality front tab portions being disposed within first plurality notches, third plurality rear tab portions being disposed within second plurality notches, non-tab portions of first plurality right edges flushly abutting third plurality left faces, non-tab portions of second plurality left edges flushly abutting third plurality right faces, non-tab portions of third plurality front edges flushly abutting first plurality rear faces, and non-tab portions of third plurality rear edges flushly abutting second plurality front faces; and wherein the composite of top edges of all first plurality slat-like members define a portion of the seat surface, the composite of top edges of all second plurality slat-like members define portions of the seat and backrest surfaces, and the composite of top edges of all third plurality slat-like members define portions of the seat and backrest surfaces.

6. The article of furniture of claim 5, wherein spacing members are disposed between at least some adjacent, parallel slat-like members.

7. The article of furniture of claim 6, wherein said spacing members are adhesively bonded to the slat-like members that they are disposed between.

8. The article of furniture of claim 5, wherein most of said first, second and third plurality slat-like members have an interior void.

* * * * *